US009330802B2

(12) United States Patent
Ioffe et al.

(10) Patent No.: US 9,330,802 B2
(45) Date of Patent: May 3, 2016

(54) BAND-SHAPED CHOPPER FOR A PARTICLE BEAM

(71) Applicant: FORSCHUNGSZENTRUM JUELICH GMBH, Juelich (DE)

(72) Inventors: Alexander Ioffe, Hennef (DE); Peter Stronciwilk, Aachen (DE)

(73) Assignee: Forschungszentrum Juelich GmbH, Juelich (DE)

( * ) Notice: Subject to any disclaimer, the term of this patent is extended or adjusted under 35 U.S.C. 154(b) by 0 days.

(21) Appl. No.: 14/434,612

(22) PCT Filed: Sep. 19, 2013

(86) PCT No.: PCT/DE2013/000533

§ 371 (c)(1),
(2) Date: Apr. 9, 2015

(87) PCT Pub. No.: WO2014/075649

PCT Pub. Date: May 22, 2014

(65) Prior Publication Data

US 2015/0279494 A1 Oct. 1, 2015

(30) Foreign Application Priority Data

Oct. 20, 2012 (DE) ..... 10 2012 020 636

(51) Int. Cl.
*G21K 1/04* (2006.01)
*G21K 1/00* (2006.01)

(52) U.S. Cl.
CPC ..... *G21K 1/043* (2013.01)

(58) Field of Classification Search
CPC ..... G21K 1/04; G21K 1/043; G01S 7/481
USPC ..... 250/343, 203.2, 341.1, 396 R; 378/160, 378/34
See application file for complete search history.

(56) References Cited

U.S. PATENT DOCUMENTS 2,673,297 A * 3/1954 Miller ..... G01N 21/35 250/229
2,926,253 A * 2/1960 Munday ..... G01N 21/3577 250/343

(Continued)

FOREIGN PATENT DOCUMENTS

DE 20 2004 011 832 12/2004
DE 10 2004 002 326 8/2005

(Continued)

OTHER PUBLICATIONS

PCT/DE2013/000533 International Search Report dated Feb. 28, 2014.
German Office Action dated Jun. 11, 2013 of application No. DE 10 2012 020 636.4.

*Primary Examiner* — David A Vanore
(74) *Attorney, Agent, or Firm* — Jordan and Hamburg LLP

(57) ABSTRACT

A chopper for a particle beam comprises at least one control element, which is divided into at least two regions A and B, wherein region B is less transparent to the particle beam than region A, and at least one drive source for moving the control element through the particle beam in such a way that the beam impinges on regions A and B in a chronologically alternating manner. The control element has a band-shaped design and is non-positively seated against the outer circumference of at least one element that can be caused to rotate by the drive source. It was found that the chopper can have a significantly more space-saving design when the control element is designed as a band-shaped element than as a wheel-shaped or ring-shaped chopper according to the known art. In particular, the drive source, which is bulky compared to the control element, can be disposed spatially separated from the beam path, while the band itself transmits the force of the drive source.

7 Claims, 10 Drawing Sheets

(56) References Cited

U.S. PATENT DOCUMENTS 3,184,679 A 5/1965 Kuchue et al.
5,365,561 A * 11/1994 Ebinuma ..... G03F 7/70058 378/160
5,533,692 A * 7/1996 Layton ..... F41G 7/263 244/3.13
5,581,590 A 12/1996 Mori et al.
5,686,722 A * 11/1997 Dubois ..... G01S 17/74 250/203.2
8,324,590 B2 * 12/2012 Renftle ..... G21K 1/043 250/396 R
2009/0103686 A1 4/2009 Rothschild

FOREIGN PATENT DOCUMENTS

DE 10 2007 046 739 7/2009
WO WO-2011/115923 9/2011

* cited by examiner

BAND-SHAPED CHOPPER FOR A PARTICLE BEAM

BACKGROUND OF THE INVENTION

The invention relates to a chopper for a particle beam.

When using particle beams, such as for research purposes, it is frequently important to modulate the beam into pulses that are defined in space and time. For this purpose, choppers comprising a control element are used, which include regions that allow the particle beam to pass to varying degrees. By moving the control element through the particle beam, the particle beam alternately impinges on regions having higher and lower transmission, and is thus modulated.

From DE 10 2004 002 326 A1, choppers configured as wheels are known, which are rotated through the particle beam. The circumferential speed at the edge of the chopper wheel defines the frequency with which the particle beam can be modulated.

A refinement of these choppers is known from DE 10 2007 046 739 A1, in which a small control element periodically revolves around a fixed guide element, which defines the path of the control element. Considerably less mass has to be moved in order to modulate the particle beam, which avoids placing high mechanical stress on the material due to centrifugal forces, and undesirable natural oscillations.

The disadvantage is that the chopper wheel or the guide element requires a lot of space. This space, however, is constrained, especially in large scientific devices which produce particle beams, so as to give the largest possible number of users an opportunity to use it. At the same time, there is great interest in modulating the beam as close to this generation site as possible, so as to be able to use the largest possible number of neutrons during a specified pulse duration, particularly in spallation neutron sources or research reactors, which initially emit neutrons in all directions analogously to a punctiform source, starting from the generation site of neutrons. However, the closer the chopper is to the neutron generation site, the less space is available.

Moreover, the pulse duration and repetition rate cannot be varied independently of each other in existing choppers, because the two variables are tied to the circumferential frequency of the control element.

It is therefore the object of the invention to provide a chopper which requires less space in the immediate vicinity of the beam path of the particle beam that is to be modulated than choppers according to the prior art. A further object of the invention is to decouple the pulse duration and the repetition rate from each other so that both variables can be optimally selected for the particular use.

This object is achieved according to the invention by a chopper according to the main claim and by a method according to the additional independent claim. Further advantageous embodiments will be apparent from the dependent claims.

Within the scope of the invention, a chopper for a particle beam was developed. This chopper comprises: at least one flexible control element, which is divided into at least two regions A and B, wherein region B is less transparent to the particle beam than region A, in particular region B is not transparent to the particle beam at all; and at least one drive source for moving the control element through the particle beam in such a way that the particle beam impinges on regions A and B in a chronologically alternating manner.

According to the invention, the control element has a band-shaped design and is non-positively seated against the outer circumference of at least one element that can be caused to rotate by the drive source.

It was found that the chopper can have a significantly more space-saving design when the control element is designed as a band-shaped element than as a wheel-shaped or ring-shaped chopper according to the known art. In particular, the drive source, which is bulky compared to the control element, can be disposed spatially separated from the beam path while the band itself transmits the force from the drive source. For example, the band can be deflected by one or more rollers, and the drive source can be positioned far away from the beam path in a location where space is no longer scarce. The band can also be guided through a narrow aperture in a wall into a different space, in which the drive source is located. The speed with which the control element is moved through the particle beam can then be increased by enlarging the circumference of the element that can be caused to rotate.

As a result of the space savings, the user attains additional freedom in terms of the direction in which the control element is moved through the particle beam. For example, if the particle beam does not have a square cross-section, but rather has a rectangular cross-section, the minimally achievable pulse duration can be decreased, while keeping the linear speed of movement the same, by moving the control element along the short side of the rectangular cross-section through the particle beam. It is particularly advantageous for this purpose if the control element is also flexible (twistable) in itself, because it can then also be moved along a bent progression.

Since the drive source is no longer necessarily required to be disposed close to the location at which the particle beam impinges on the chopper, it is advantageously protected from potential radiation damage, which improves the durability of the chopper. When a neutron beam serves as the particle beam that is modulated by the chopper, many materials that can be used in region B to intercept the neutron beam are activated by the impinging neutrons and, in turn, emit strong gamma radiation. This radiation attacks organic molecules by breaking up chemical bonds and prompting the formation of free radicals. The insulation of the windings in electric motors, which are frequently used as the drive source, contains organic molecules, and is thus attacked by the gamma radiation over time, so that the motor ultimately fails due to short circuiting.

It was further found that, compared to solid chopper wheels, the control element has a very low mass and that, as a result of the non-positive seating against the element that can be caused to rotate by the drive source, a change or even reversal in the rotational speed of this element immediately affects the control element, without having to overcome a large moment of inertia. The movement speed with which the control element is moved through the particle beam can thus be varied. In particular, in the configuration of the control element in which at least a subregion of the particle beam passes exclusively through region A of the control element, the drive source can be operated at a different movement speed than in the configuration of the control element in which the particle beam completely impinges on a region B. The first movement speed is then decisive for the pulse duration within which the chopper is more transparent to the particle beam. The latter movement speed is decisive for the repetition rate, which is to say the duration between the pulses. The two speeds can be selected independently of each other in keeping with the demand that arises from the particular use. While it was possible to vary the circumferential frequency of the control element according to the prior art, it was not possible to vary the circumferential speed during a single revolution. The chopper according to the invention can achieve at least the performance of existing wheel choppers for each of the two speeds, and due to the lower moving mass it rather tends to achieve better performance.

The chopper according to the invention moreover allows a more flexible response to a change in the beam cross-section, and more particularly in the beam height, than with conventional wheel choppers. For example, if there is a change in the beam height perpendicular to the movement direction, the control element only has to be widened to modulate the beam in the same manner as before. With a wheel chopper, regions A and B would have to be redesigned in the same situation, with consideration for the circumferential speed being dependent on the radial distance from the rotational axis, so that the beam is closed or opened across the entire cross-sectional surface thereof for the same duration.

The control element can advantageously be expanded in the movement direction. In this way, it can be continuously maintained under mechanical stress, which improves the force fit with the element that can be caused to rotate. In particular, the control element does not have to be pressed externally against the element that can be caused to rotate. In this way, a coating can be applied in subregions, for example on the outer side of the control element which does not have non-positive contact, the coating forming regions B allowing less of the particle beam to pass. Both the pressing mechanism and the coating itself wear quickly when the coating is repeatedly rolled between the pressing mechanism and the element that can be caused to rotate.

Moreover, an expandable control element avoids placing extreme mechanical stresses on the control element during a change, or even reversal, of the movement speed of the drive source. The expandable control element additionally has damping properties, so that oscillations originating from the drive source are essentially unable to propagate to the location at which the beam is modulated. Wheel choppers, in contrast, are rigid systems and are susceptible to oscillations.

As an alternative, or in combination, in a further advantageous embodiment of the invention, a damping element, for example a torsion spring, is disposed in the force fit between the drive source and the control element. The damping element dissipates the energy of the oscillations originating from the drive source.

The torque with which the drive source moves the control element by way of the element that can be caused to rotate, and the area density of the control element should be matched to each other, so that the operation of the drive source is not impaired. The control element advantageously has a mean area density of less than 50 g per meter in length. The lighter the material, the lower are the forces that are needed for the drive and for any directional change of a rapid movement. For example, if the band is continuous, there are necessarily reversal points along the length of the band at which even a movement having a steady speed becomes an accelerated movement.

As a result, both the control element itself and the mechanics for the deflection thereof are subjected to forces at the reversal point.

In particular, a carbon fiber band, or a band made of a fiber composite material, having a thickness between 0.025 mm and 0.5 mm, and preferably having a thickness of 0.1 mm or less, is suitable as a control element. These materials are both lightweight and expandable in the movement direction. They are very transparent to neutron beams serving as the particle beam, and thus form regions A, Regions B are formed on the band either by introducing a neutron-absorbing material into the band, or by applying a neutron-absorbing material to both sides of the band, or integrating the same into the band. Suitable neutron-absorbing materials are $^{10}B$ or Gd, for example, which can be applied to the band, for example embedded into a polymer, in a layer thickness between 0.1 and 0.5 mm. However, the control element can also be a metallic band having apertures through which the particles can pass. The apertures then form regions A, while the metallic band itself forms the non-transparent region B. Typically, the control element is substantially (95%) composed of regions B that are not transparent to neutrons, and has only few neutron windows (regions A), which are transparent to neutrons.

Region A is advantageously at least 75%, preferably at least 90%, most particularly preferably at least 95% transparent to the particle beam, and ideally is entirely transparent to the particle beam. Region B is advantageously no more than 10%, preferably no more than 1%, most particularly preferably no more than 0.1% transparent to the particle beam, and ideally is completely non-transparent to the particle beam.

In a particularly advantageous embodiment of the invention, the control element is a continuous band. The drive source can then be operated steadily, while the particle beam can still be periodically modulated. In particular, it is not necessary to repeatedly stop and reverse the movement with high acceleration forces.

The control element can be guided on a path (in one layer) through the beam path and around the beam path on the return path. In a particularly advantageous embodiment of the invention, however, the control element is guided in at least two layers through the beam path of the particle beam, and comprises at least two regions A and two regions B in each case. These regions are disposed with respect to each other in such a way that, in at least one configuration of the control element, which can be established by the drive source, at least a portion of the particle beam passes through a region A in both layers. It is then not necessary to guide the control element around the beam path on the return path. Rather, both paths can run in one plane, so that the band does not have to be twisted. In this configuration, the entire particle beam advantageously passes through a respective region A in both layers.

The distance between the two layers in the beam direction can advantageously be varied. This can be achieved, for example, by guiding the two layers over separate roller pairs. By guiding the second pair of rollers, over which the second layer is guided, closer together, while also guiding them away from the first layer in the beam direction, the distance between the two layers can be increased, while maintaining the length of the control element. This can be used to allow only particles having a speed within a certain range to pass in the flight times thereof (speed filter).

In a particularly advantageous embodiment of the invention, in at least one configuration of the control element which can be established by the drive source, the particle beam impinges on a region B in the second layer to the extent that it passes through a region A in the first layer. The two layers then contribute, in sum, to the formation of a window that is transparent to the particle beam for the shortest possible time. In this configuration, half of the beam cross-section is ideally blocked by a region B in the first layer. The second half of the beam cross-section passing through a region A in the first layer is then blocked by a region B in the second layer. The pulse duration can then be cut in half. This effect can be achieved not only with two layers of one and the same continuous band, but also with two bands that are not connected, the movements of which are simply synchronized.

Based on the above, the invention also relates to a method for operating a chopper according to the invention. In the configuration of the control element in which at least a sub-region of the particle beam passes exclusively through region A of the control element, the drive source is operated at a different movement speed than in the configuration of the control element in which the particle beam completely impinges on a region B. The effect of this is that the pulse duration and the repetition rate can be set independently of each other.

The subject matter of the invention will be described hereafter based on figures, without thereby limiting the subject matter of the invention.

DESCRIPTION OF THE PREFERRED EMBODIMENTS

Figure 1A:
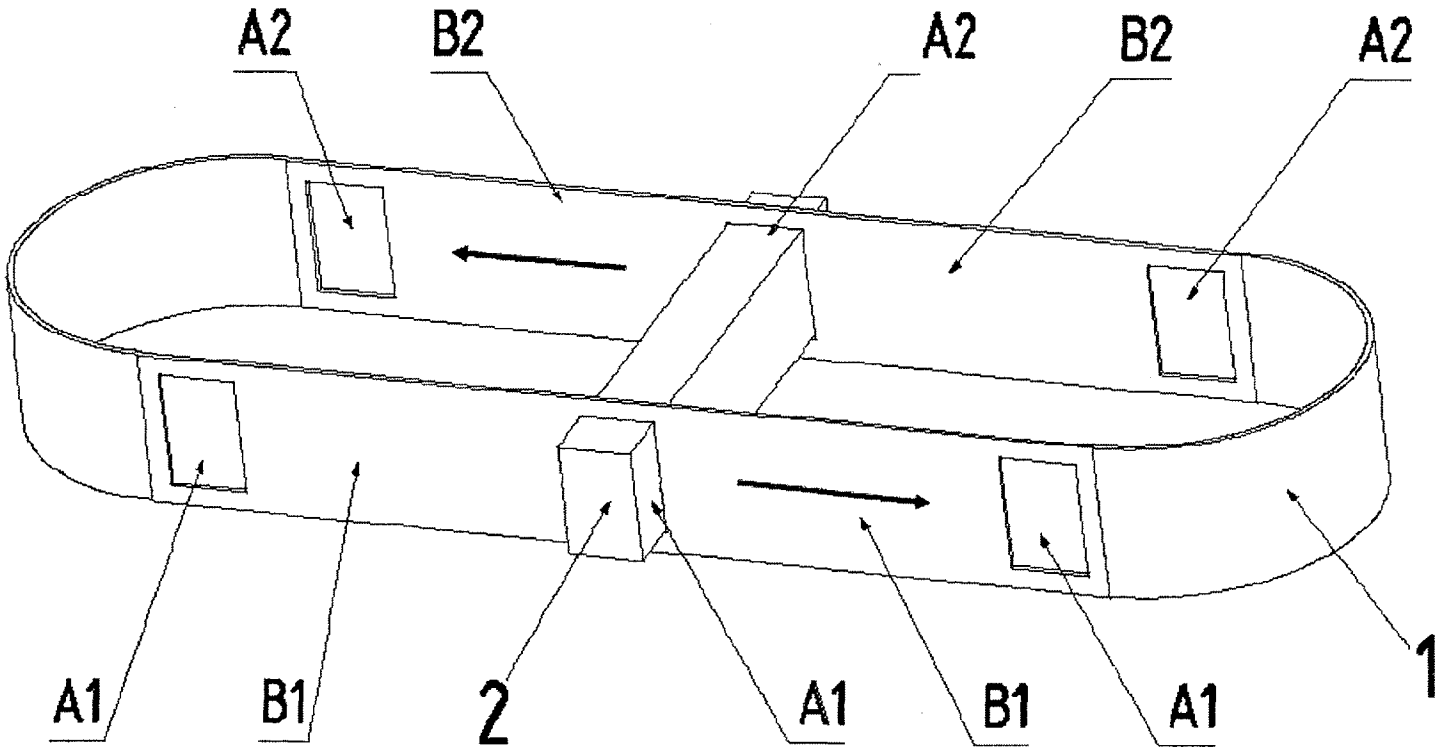
FIG. 1: shows an exemplary embodiment of the chopper according to the invention.

FIG. 1*a* shows a schematic perspective drawing of an exemplary embodiment of a chopper according to the invention, in which the drive source and the element that can be caused to rotate by the same are not shown for reasons of clarity. The control element 1 is a continuous band that is 0.1 mm thick and made of carbon fiber, in which regions B1, B2 are coated with $^{10}B$ as a neutron-absorbing material. Regions A1, A2 are not coated; these regions serve as neutron windows. The band runs in a plane and is thus guided in two layers through the beam path 2 of the neutron beam. The two layers move in different directions, which are indicated by arrows. Regions A1, A2 are disposed with respect to each other in such a way that a band position is achieved in which a region A1 in the first layer and, at the same time, a region A2 in the second layer, are located in the line of the beam path. In this position, the chopper is transparent to the neutron beam 2. If, in contrast, all the neutrons are absorbed by either a region B1 of the first layer or by a region B2 of the second layer of the band, the chopper altogether blocks (is closed to) the neutron beam. The designation as to the layer in which a region is located (A1 or A2, or B1 or B2) refers to the current state represented in FIG. 1*a*. Naturally, the regions migrate from one layer to another as the band revolves.

Figure 1B:
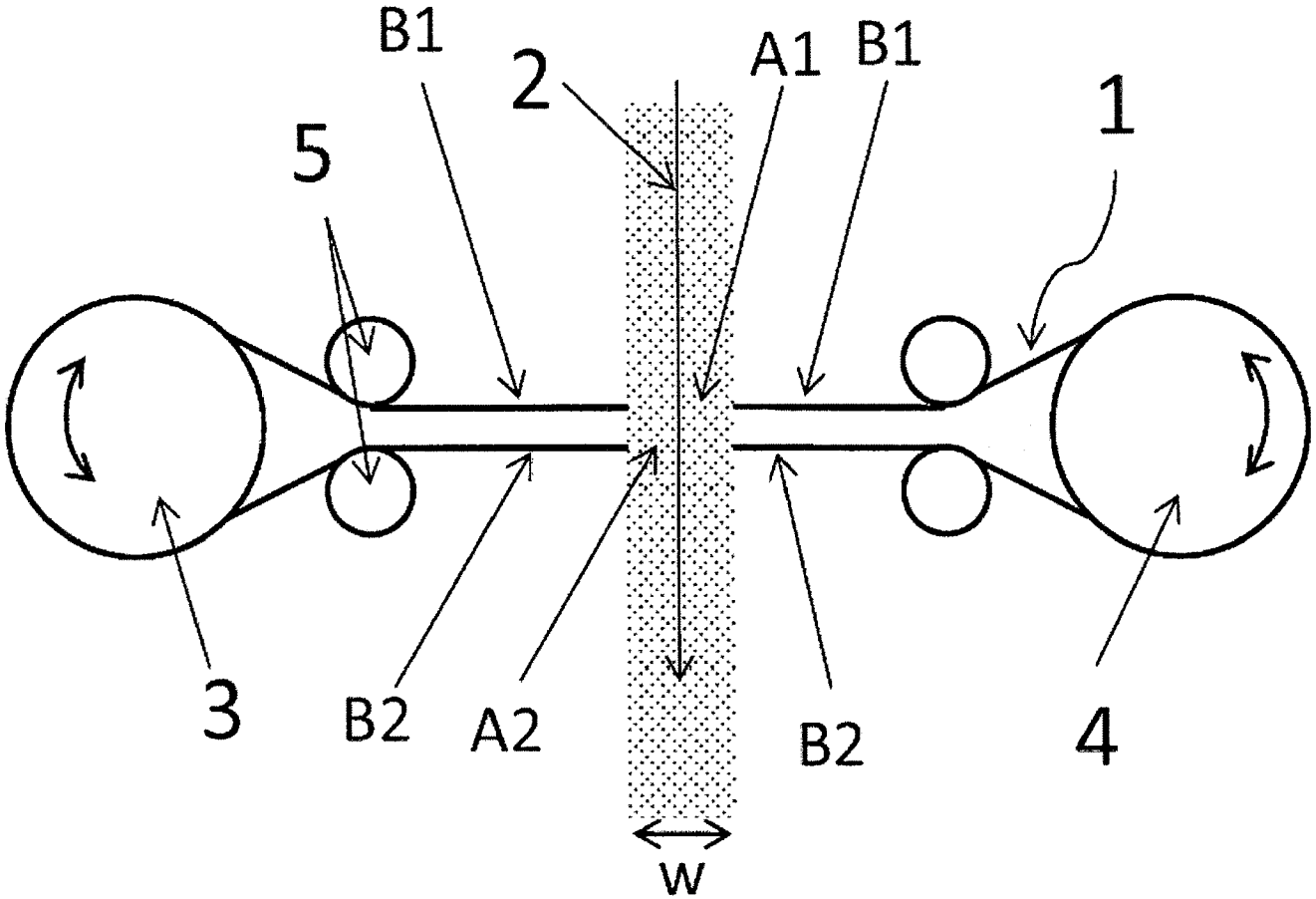

FIG. 1*b* shows this exemplary embodiment in a top view of a further schematic drawing. The control element 1 is clamped between two rollers 3 and 4 and is non-positively seated against the respective outer circumference of the same. The roller 3 can be caused to rotate by the drive source, which urges the belt to revolve. The drive source is a direct current motor, which can drive the roller 3 in both directions of rotation. The band (control element) is guided by further non-driven rollers 5 so that the two layers in which the band is guided through the neutron beam 2 run parallel to each other and are located closely next to each other. If the neutrons are conducted in evacuated neutron conductors, only a minimal gap between two neutron conductors, which the neutrons must traverse in air, is required for the installation of the chopper. Moreover, the closer the two layers are located next to each other, the more precisely defined the pulse width is.

In the snapshot shown in FIG. 1*b*, two regions B1 that are non-transparent to neutrons and one region A1 that is transparent to neutrons are present in the first layer of the band. Likewise, two regions B2 that are non-transparent to neutrons and one region A2 that is transparent to neutrons are present in the second layer of the band. Regions A1 and A2 are located behind each other in the direction of the neutron beam 2 so that the neutron beam is allowed to pass in each case, and can pass the chopper in an overall undiminished manner. FIG. 1*b* thus shows the open state of the chopper.

Figure 1C:
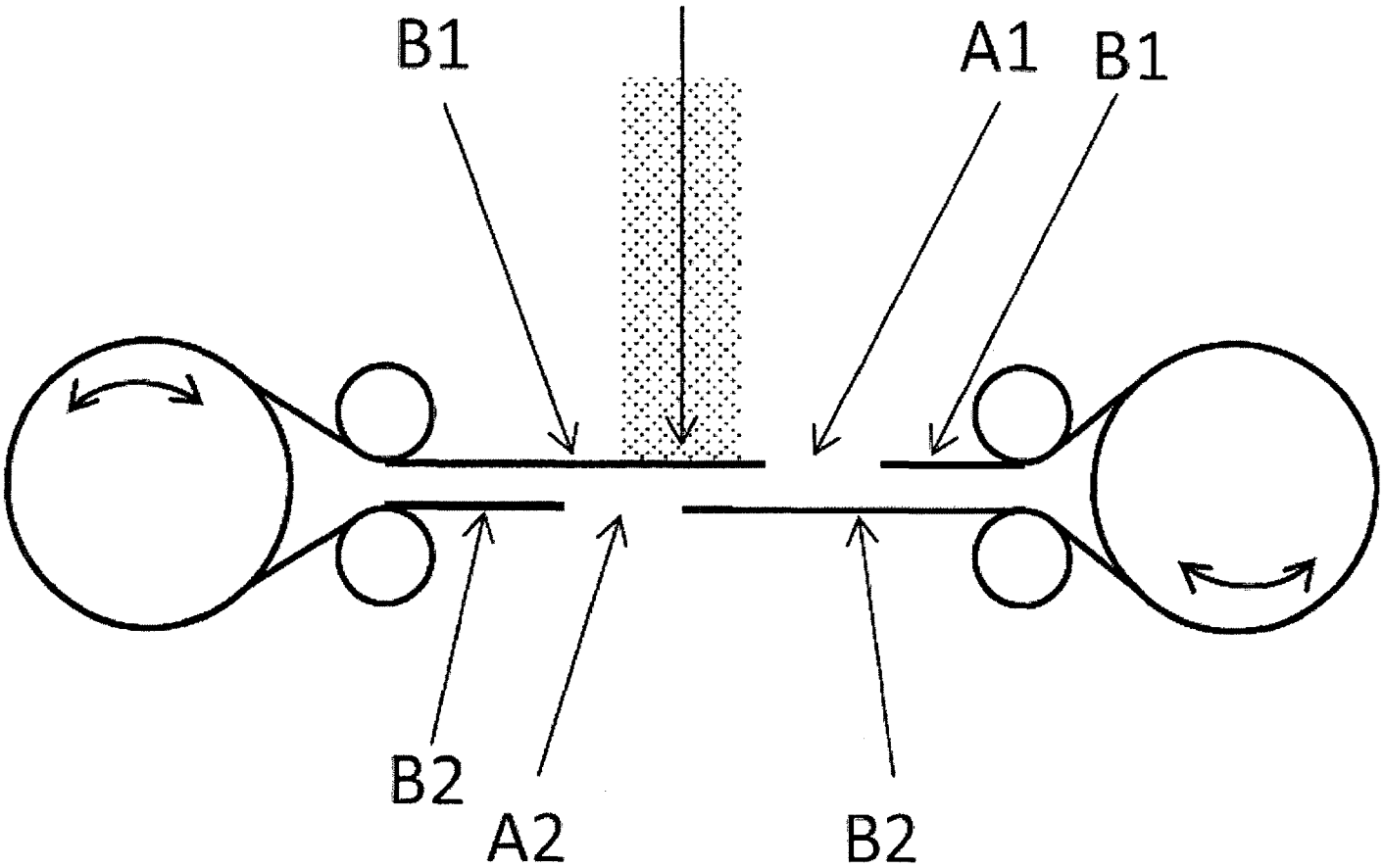

FIG. 1*c* shows a further snapshot. Compared to FIG. 1*b*, the roller 3 has rotated clockwise. Region A1 has accordingly migrated to the right, while region A2 has migrated to the left. At the same time, the neutron beam 2 is still incident on the band 1 in the same location and with the same beam width w. The beam already impinges on a non-transparent region B1 in the first layer and is absorbed, so that it cannot even reach the second layer and most definitely cannot pass the chopper as a whole. FIG. 1*c* thus shows the closed state of the chopper.

FIG. 2 schematically shows the generation of a neutron pulse using the chopper illustrated in FIG. 1. The first layer of the band has regions A1 that are transparent to the neutron beam, and regions B1 that are not transparent to the neutron beam. The second layer of the band has regions A2 that are transparent to the neutron beam, and regions B2 that are not transparent to the neutron beam. For the majority of the time, the beam entirely impinges on a non-transparent region B1 in the first layer of the band and is thus blocked (FIG. 2*a*). The two layers of the band counter-revolve in relation to each other in the directions indicated by arrows.

Figure 2A:
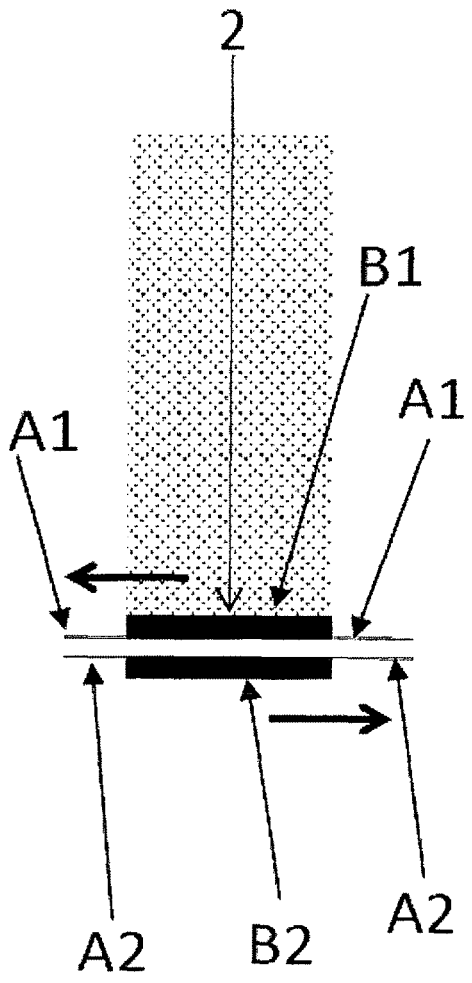
FIG. 2: shows a generation of a neutron pulse using the chopper shown in FIG. 1.
Figure 2B:
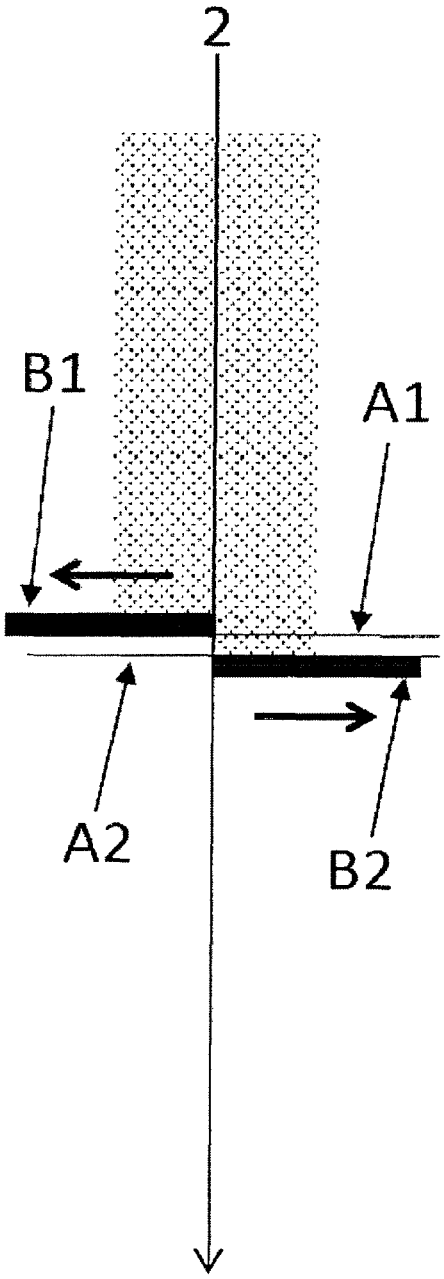

Exactly one half of the beam is blocked by the region B1 in the first layer at the point at which the chopper as a whole is only minimally transparent. Initially, the other half of the beam still penetrates to the second layer. There, this half is blocked by region B2 so that, in the overall, no neutrons pass the chopper (FIG. 2*b*).

Figure 2C:
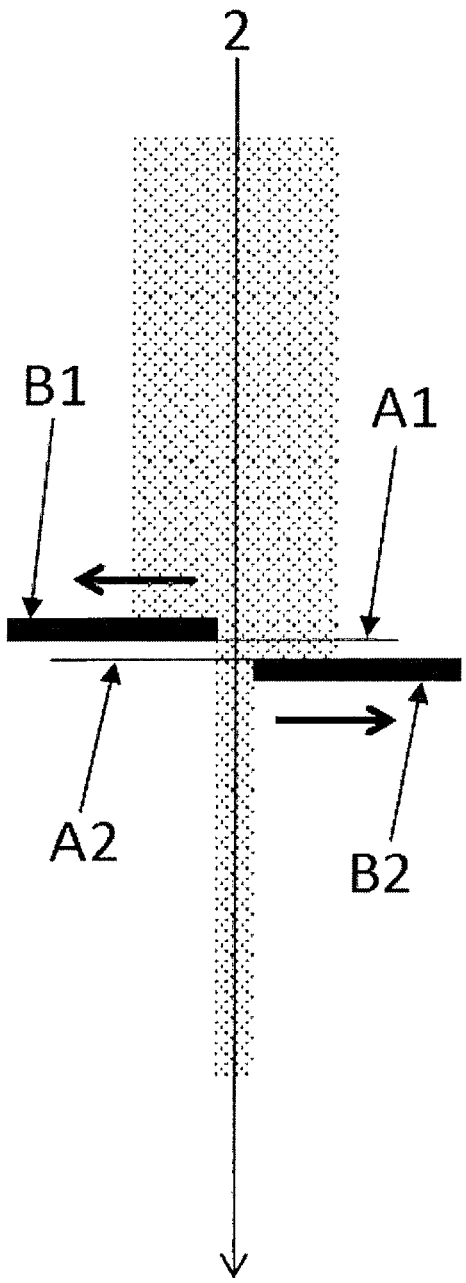

Any further movement of the band in the same direction now causes the beam to no longer be completely blocked, but for a gap to arise between regions B1 and B2. The portion of the neutron beam that was avowed to pass through a region A1 in the first layer is not completely blocked by a region B2 in the second layer, but impinges on a transparent region A2 there, (FIG. 2*c*). The portion of the neutron beam that was not blocked in either one of the two layers of the band is allowed to pass by the overall chopper.

Figure 2D:
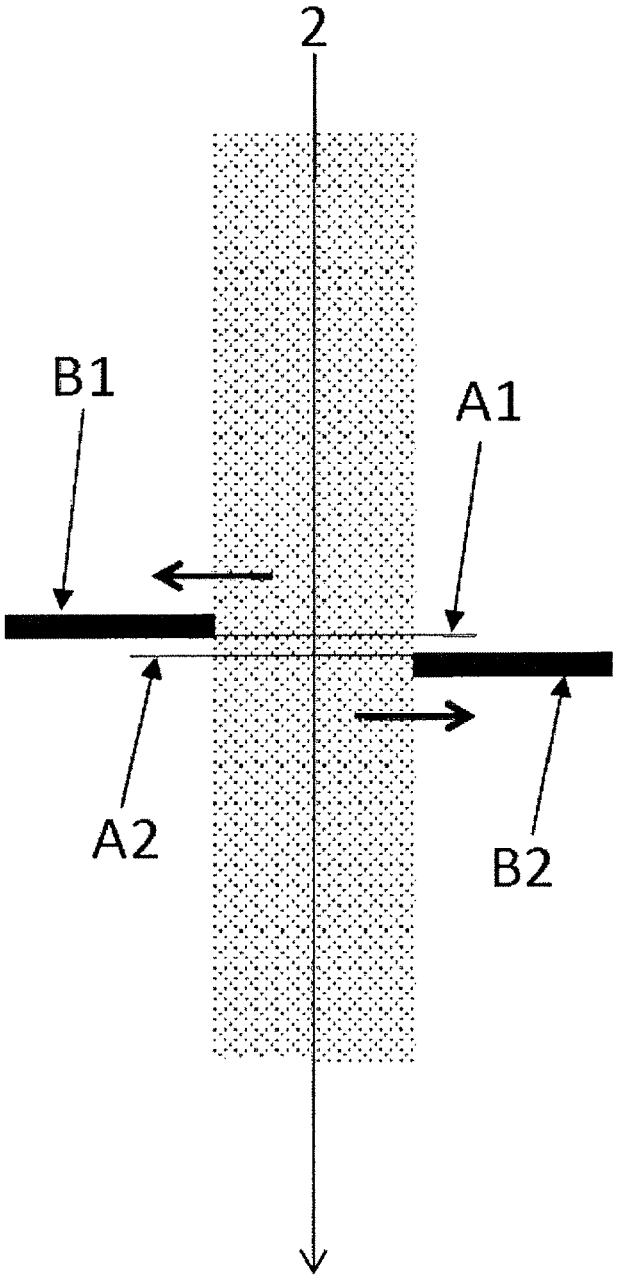

Following a time w/(2*v), where w denotes the beam width and v the linear speed of the band, the neutron beam initially completely passes through the transparent region A1 in the first layer, and subsequently through the transparent region A2 in the second layer. It is thus, in the overall, allowed to pass undiminished by the chopper. At this moment, the neutron pulse reaches the maximum intensity thereof (FIG. 2*d*).

Figure 2E:
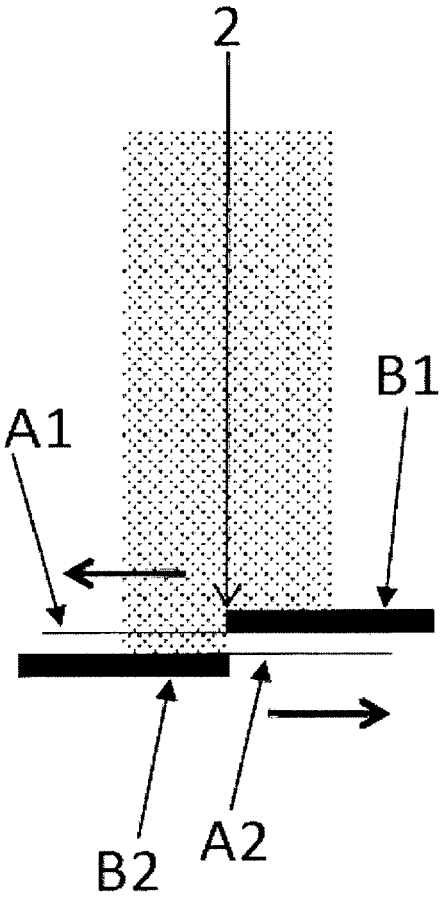

The further movement of the band now causes a region B1 in the first layer of the band to yet again enter the right half of the neutron beam, while at the same time in the second layer of the band a region B2 enters the left half of the neutron beam. Following a further time w/(2*v), the left half of the neutron beam passes through region A1 in the first layer of the band, however it impinges on region B2 in the second layer. The right half of the neutron beam already impinges on region B1 in the first layer, where it is absorbed. The overall chopper no longer allows any neutrons to pass. The neutron pulse has ended (FIG. 2*e*).

Figure 2F:
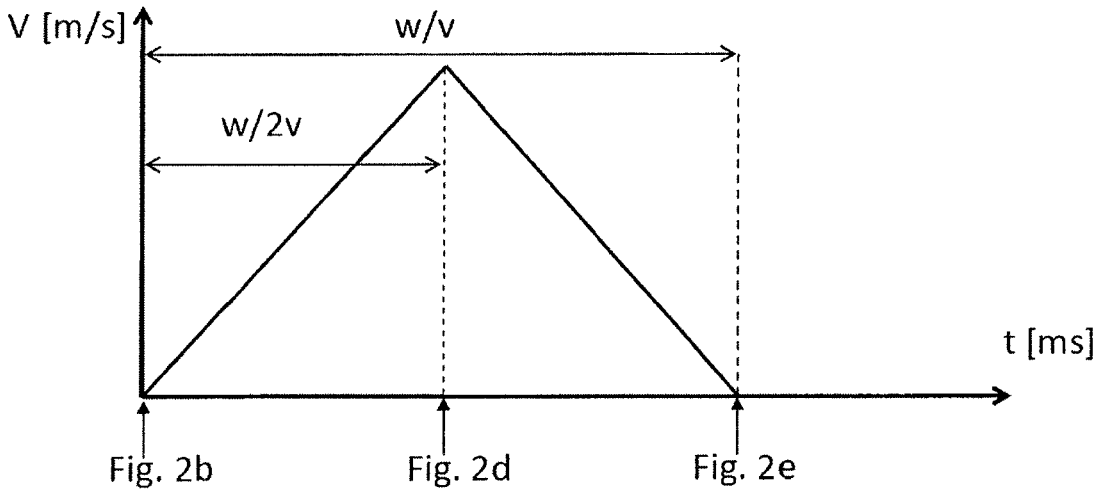

The intensity progression during the pulse is plotted against time in FIG. 2*f*. If the time during which any neutrons at all can pass the chopper is regarded as the pulse duration, then the pulse duration is $\tau = w/v$. If, however, the time during which the pulse is at least at half the maximal intensity thereof (full width half maximum) is regarded as the pulse duration, then the pulse duration is $\tau_{FWHM}=w/(2*v)$.

In this exemplary embodiment, a pulse duration of approximately 3 ms can be achieved at a repetition rate of 14 Hz. The time period T between two pulses results from T=I/v, where I is the length to move the band from one pulse start according to FIG. 2*b* to the next such pulse start. The length depends on the distribution of regions A and B on the band. T can be varied during operation by operating the drive source at a different speed in the closed state of the chopper than during a pulse. Typically, preferably short pulses are desired, so that the band runs much more quickly during a pulse than between the pulses. In the case of wheel choppers or Fermi choppers, the pulse duration and repetition time T cannot be set independently of one another to this degree.

Figure 3:
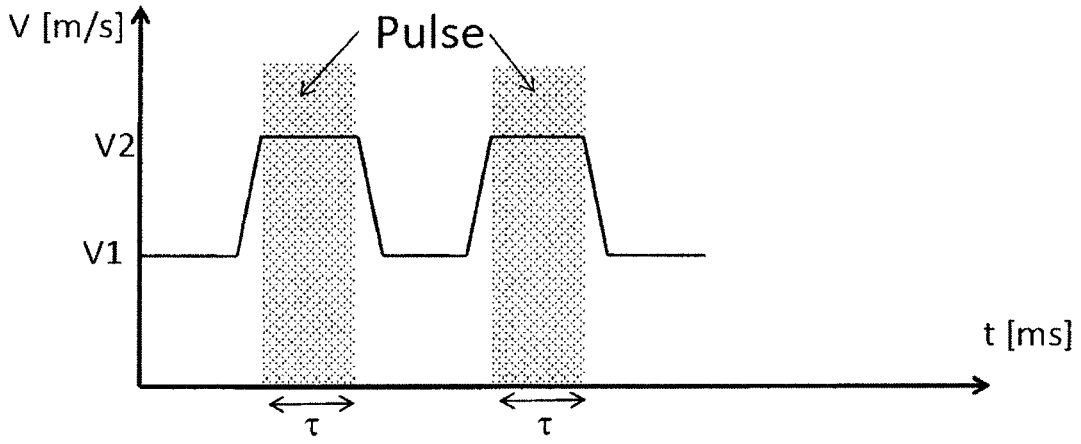
FIG. 3: shows a modulation of the advancement speed of the control element.

FIG. 3 shows a possible curve of the linear speed v of the band over the time t. The advancement of the band is alternated between two different working speeds $v_1$ and $v_2$. Between the pulses, the band moves at the speed $v_1$. The band is thus accelerated in time before the start of a pulse at the maximum possible rate so that it runs at the considerably higher speed $v_2$ for the duration $\tau$ of the pulse. $\tau$ is either defined by way of the full width at half maximum (FWHM) or by way of the time period during which any number of neutrons other than zero passes the chopper. After the pulse has expired, the band is decelerated with the maximum possible retardation until it runs again at the speed $v_1$.

The carbon fiber band can not only be coated with $^{10}B$ or Gd as neutron absorbers, it can also be saturated with these materials in conjunction with a binding agent. The neutron absorber (region B) is then less susceptible to damage during bending of the band, such as when passing over rollers, than a coating would be, which can flake over time. Should the band tear or lose the coating thereof, the advantage is that it is considerably easier to replace than a bulky and heavy wheel chopper, so that less of the precious measuring time is taken up by the repair.

The invention claimed is:

1. A chopper for a particle beam, comprising: at least one flexible control element, which is divided into at least two regions A and B, wherein region B is less transparent to the particle beam than region A; and at least one drive source for moving the control element through the particle beam in such a way that the same impinges on regions A and B in a chronologically alternating manner, wherein the control element has a band-shaped design and is non-positively seated against the outer circumference of at least one element that can be caused to rotate by the drive source, and wherein the control element can be expanded in the movement direction.

2. A chopper for a particle beam, comprising: at least one flexible control element, which is divided into at least two regions A and B, wherein region B is less transparent to the particle beam than region A; and at least one drive source for moving the control element through the particle beam in such a way that the same impinges on regions A and B in a chronologically alternating manner, wherein the control element has a band-shaped design and is non-positively seated against the outer circumference of at least one element that can be caused to rotate by the drive source, and wherein a damping element is disposed in the force fit between the drive source and the control element.

3. A chopper according to claim 1, wherein the control element is a continuous band.

4. A chopper for a particle beam, comprising: at least one flexible control element, which is divided into at least two regions A and B, wherein region B is less transparent to the particle beam than region A; and at least one drive source for moving the control element through the particle beam in such a way that the same impinges on regions A and B in a chronologically alternating manner, wherein the control element has a band-shaved design and is non-positively seated against the outer circumference of at least one element that can be caused to rotate by the drive source, and wherein the control element is guided in at least two layers through the beam path of the particle beam and comprises, in each case, at least two regions A and two regions B, wherein these regions are disposed with respect to each other in such a way that, in at least one configuration of the control element that can be established by the drive source, at least a portion of the particle beam passes through a respective region A in both layers.

5. The chopper according to claim 4, wherein the distance between the two layers in the beam direction can be varied.

6. The chopper according to claim 4, wherein in at least one configuration of the control element that can be established by the drive source, the particle beam impinges on a region B in the second layer to the extent that it passes through a region A in the first layer.

7. A method for operating a chopper for a particle beam, the chopper comprising: at least one flexible control element and at least one drive source, wherein the control element is divided into at least two regions A and B, wherein region B is less transparent to the particle beam than region A, and wherein the control element has a band-shaped design and is non-positively seated against an outer circumference of at least one element that can be caused to rotate by the at least one drive source, the method comprising:

moving the control element through the particle beam by the at least one drive source in such a way that the particle beam impinges on regions A and B in a chronologically alternating manner; and operating the drive source at a different movement speed for the configuration of the control element in which at least a subregion of the particle beam passes exclusively through region A of the control element than in the configuration of the control element in which the particle beam completely impinges on a region B.

* * * * *